US005271524A

United States Patent [19]

Marston

[11] Patent Number: 5,271,524

[45] Date of Patent: Dec. 21, 1993

[54] DISPENSING CAP

[76] Inventor: Brian Marston, 10 Milford La., West Milford, N.J. 07480

[21] Appl. No.: 752,243

[22] Filed: Aug. 21, 1991

[51] Int. Cl.[5] ..... B67D 3/00

[52] U.S. Cl. ..... 222/1; 222/507; 222/525

[58] Field of Search ..... 222/509, 521, 525, 545, 222/523, 507, 1

[56] References Cited

U.S. PATENT DOCUMENTS

| | | | |
|---|---|---|---|
| 2,127,040 | 8/1938 | Mann | 222/507 |
| 4,020,981 | 5/1977 | Nixdorff | 222/525 |
| 4,179,052 | 12/1979 | Abbott | 222/509 |
| 4,927,065 | 5/1990 | Beck | 222/521 X |

*Primary Examiner*—Gregory L. Huson
*Attorney, Agent, or Firm*—Weingram & Zall

[57] ABSTRACT

A dispensing cap apparatus is provided for dispensing a fluid from a container. The cap includes a base portion and a cover cap portion which are slidably moveable with respect to each other. The base includes a cam surface and the cover cap includes a cam follower. Opening the apparatus requires squeezing opposing sides of the cover cap to move the cam follower against the camming surface which forces the cover cap into a raised position to unseal the cap and allow fluid to flow thereout. In another embodiment, a portion of the base is cammed downward with respect to their cover cap to open the apparatus. Also included as embodiments are a child-proof embodiment wherein the cover cap must first be aligned with the base before the apparatus may be opened and an embodiment wherein the camming surface and cam follower coact to prevent the cap from being closed after it has been opened.

22 Claims, 8 Drawing Sheets

FIG-7
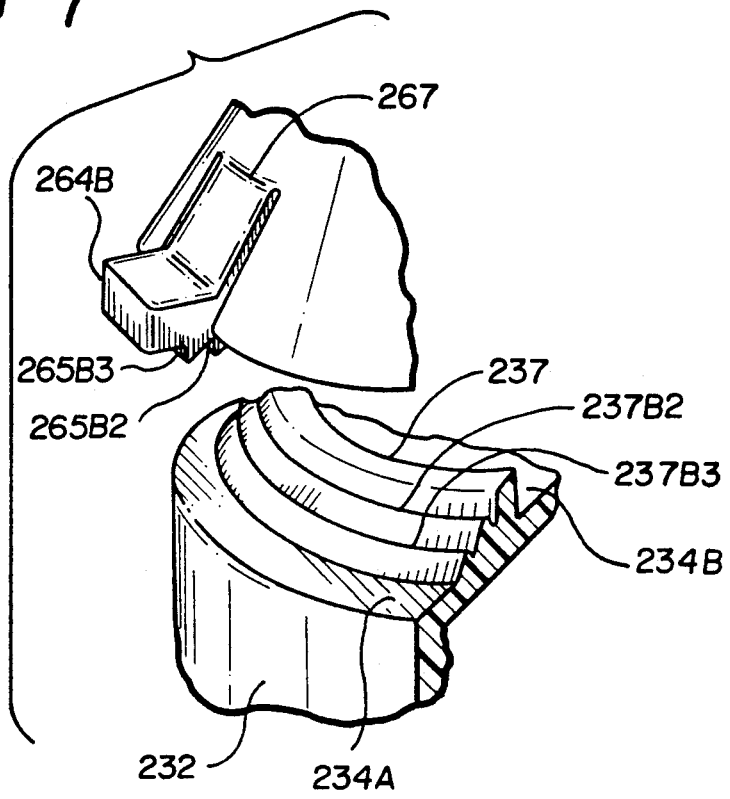
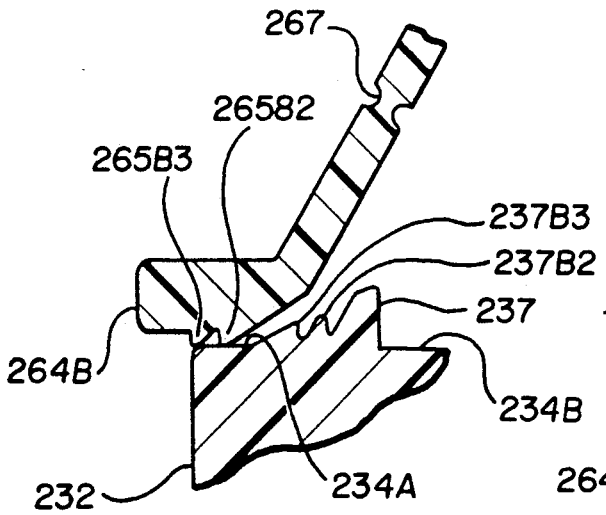
FIG-8
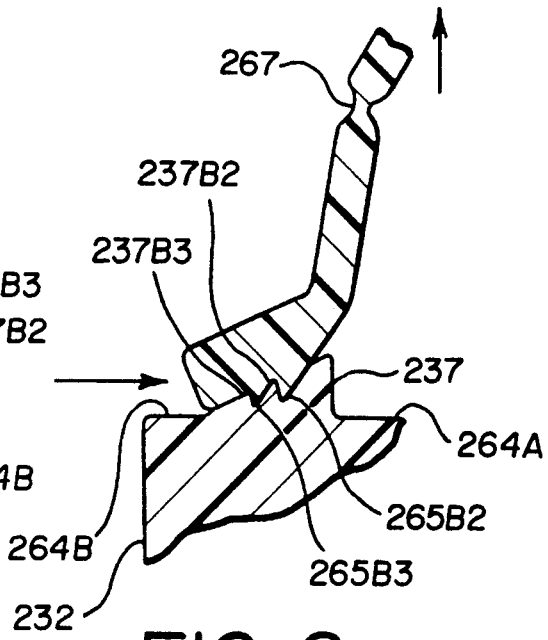
FIG-9

DISPENSING CAP

BACKGROUND OF THE INVENTION

1. Field of the Invention

This invention relates to a dispensing cap for dispensing liquid from a container, and more particularly to a snap-up dispensing cap that may be opened or closed with one hand.

2. Related Art

Attempts have been made to provide dispensing caps that may be easily opened and closed yet provide a hermetic seal. However, previous efforts have resulted in caps which are difficult or require complex manipulations to open, cannot be opened with one hand, and are unable to be adequately resealed. Further, none of the previous patents, taken either singly or in combination, are thought to provide the benefits of the present invention.

Nissen, U.S. Pat. No. 2,866,580, discloses a dispensing spout structure comprising a spout member having a dispensing passage and a base portion, and a base member, attachable to a container, having a passage therethrough and a curved upper wall having guide ways. The base portion of the spout member is slidably received by the guide ways on the base member. Dispensing may be effected only upon rotational movement of the spout member to its vertical position such that its dispensing passage registers with the passage through the base member.

Kessler, U.S. Pat. No. 3,276,640, discloses a closable pouring spout in an axially slidable cap having a plug thereon for containers of liquid. The invention comprises a cap portion and a plunger portion. The cap portion is attachable to a container and has an upstanding central cylindrical element. The sliding plunger member has a top central aperture into which merge fluted apertures. Adjacent to the fluted aperture portion, is a plug that extends downwards into the upstanding cylindrical element of the cap. The cylindrical side walls of the plunger extend over the upstanding cylindrical portion of the cap, and the plunger is slidably, vertically moveable with respect thereto. When the plunger is in its first lowered position, the plug engages a thickened area within the central cylindrical element to close off the aperture extending therethrough. When the plunger is moved vertically upward to a second position, the plunger is moved out of contact with the upstanding cylindrical portion allowing the contents of the container to flow through the fluted apertures and through the top central aperture of the plunger.

Henchert, U.S. Pat. No. 3,282,477, discloses a plastic dispensing nozzle with a removable seal and cap. It includes a nozzle and a closure cap connected together by a strap. The nozzle includes a lower cylindrical portion attachable to a container, and an upper portion which defines a pouring throat. The closure cap is attachable to the nozzle by means of locking lip disposed along the skirt of the closure cap which cooperates with a camming surface on the nozzle. The nozzle further comprises a removable sealing disk for effectively sealing the contents of the container.

Lindstrom, U.S. Pat. No. 3,704,819, discloses a resealable closure for bottles and other containers comprising an elastically yielding sealing member which extends around the lip on a container to be sealed, a collar flange extending from the lower edge of the sealing member, having outside threads with asymmetrical profiles, and a cap having an annular jacket threaded on its inside with threads having asymmetrical profiles to cooperate with the corresponding threads on the collar flange. The cap may be pressed down over the collar flange to seal a container, but must be unscrewed to be opened.

Crowle et al., U.S. Pat. No. 4,002,275, discloses a safety cap for a container having a discharge member and a closing member, both of which contain latching lugs which cooperate to secure the closing member to the discharge member. Unlatching of the members is achieved by rotation of the closing member with respect to the discharge member such that the respective latching lugs are moved out of alignment.

Vere, U.S. Pat. No. 4,127,221, discloses a child-proof cap for a container having a base portion which fits on to the neck of a opening of the container. The base portion has an opening extending through its top surface. The cap also includes a top portion which removably fits over the base portion and which has an opening extending therethrough. A flexible upright locking lever extends from the base portion through the opening in the top portion, the lever having a shoulder and being biased against the perimeter of the opening in the top portion such that the shoulder extends over the top portion and prevents the top portion from being raised with respect to the base portion unless the lever is moved towards the center of the opening of the top portion. A plug on the underside of the top portion closes the opening in the base portion when the top portion is locked thereto and prevents dispensation of the contents of the container therethrough.

Lindström, U.S. Pat. No. 4,133,462, discloses a closure for a container comprising a lower part attachable to the mouth of a container having a cylindrical portion that extends into and seals with the mouth of the container. The cylindrical portion includes at least one annular flange projecting slopingly downwards. The closure includes an upper portion comprising a cover having a cylindrical stopper. When the stopper is pushed down into the lower portion, it engages the flange and provides a seal.

Poore et al., U.S. Pat. No. 4,782,964, discloses a closure assembly for a container comprising a first cap portion hingably connected to a second cap portion. The second cap portion is attachable to the mouth of a container and has an aperture to permit dispensation of the contents of the container. The first cap portion, when in the closed position, overlies the second cap portion and seals the aperture. The cap portions are attachable by a snap means, and are separated by the exertion of force to the first cap portion at its periphery and on its end opposite from the hinged connection with the second cap portion. The second cap portion includes an inwardly displaceable section at a position opposite the hinge connection with the first cap portion. The inwardly displaceable section of the second cap portion cooperates with a lip on the first cap portion such that when the two cap portions are in a closed position, inward displacement of the inwardly displaceable section forces the lip in an upward direction to overcome the snap action of the two cap portions and open the closure.

Rozenberg, U.S. Pat. No. 4,909,404, discloses tamper-evident closures comprising a cap portion and a skirt portion connected together by a separation area of weakened construction such that operation of the closure in order to remove the closure from the container acts to separate the skirt portion from the cap portion at the weakened area and thus make such tampering clearly visible.

It is thought that none of these patents, either singly or in combination, teach or suggest the efficiency, convenience, or ease of use of the invention.

SUMMARY OF THE INVENTION

The present invention sets forth a dispensing cap apparatus having a base portion that is engagable with the neck of a container and a cover cap which is engagable with the base portion. The cover cap includes a positioning tube which accepts a delivery tube extending from the base portion. The delivery tube has beads that coact with beads on the positioning tube to maintain the apparatus in a closed position until it is activated. The base portion is provided with camming surfaces which coact with manually compressible cam followers on the cap to move the tubes relative to each other to open and close the dispensing cap.

Accordingly, it is an object of the present invention to provide a dispensing cap for containers.

It is also object of the present invention to provide a dispensing cap for containers that is relatively simple to manufacture.

It is another object of this invention to provide a dispensing cap for containers that is relatively easy to fabricate.

It is another object of this invention to provide a dispensing cap that is relatively economical to produce.

It is still another object of this invention to provide a dispensing cap which is relatively reliable.

It is yet another object of this invention to provide a dispensing cap which provides a good seal when closed and free flow of contents when opened.

It is even another object of this invention to provide a dispensing cap which can be operated easily with one hand.

It is a further object of this invention to provide a dispensing cap which can be operated by people without close visual attention.

It is an even further object of this invention to provide a dispensing cap which can be operated without having to look to determine the positioning of the device by the user in order to operate it.

It is another object of this invention to provide a dispensing cap which can be produced in tamper evident modes or embodiments that would enable a person to know if the device has ever been opened or tampered with.

It is another object of this invention to provide a dispensing cap which includes an apparatus which maintains the device constantly open once it has ever been opened.

It is another object of this invention to provide a dispensing cap having a center hole which does not require orienting in order to effect controlled dispensing.

It is another object of this invention to provide a dispensing cap which has an exposed orifice to provide for easy cleaning thereof.

It is another object of this invention to provide a dispensing cap which can require constant actuation by the user in order to extract contents through the dispensing cap.

It is another object of this invention to provide a dispensing cap which will be relatively durable.

It is another object of this invention to provide a dispensing cap which can be made self-cleaning as to avoid pooling or exposure of contents and to reduce spoilage or oxidation of the contents.

It is another object of this invention to provide a dispensing cap for a container which is child-proof and requires knowledge and coordination by the user to extract contents through the dispensing cap.

It is another object of this invention to provide a dispensing cap which is child-proof but can still be operated with one hand.

It is another object of this invention to provide a dispensing cap which may be opened and closed with one hand.

It is another object of this invention to provide a dispensing cap adapted for fitting on existing containers and bottles.

It is another object of this invention to provide a dispensing cap which can be reused by transferring it from one bottle to another.

These, as well as further objects and advantages of this invention will become apparent to those skilled in the art from a review of the accompanying Detailed Description of the Preferred Embodiment, reference being made to the accompanying drawings.

BRIEF DESCRIPTION OF THE DRAWINGS

FIG. 7 is an exploded fragmentary view of the cover cap and the base portion of a non-recloseable embodiment of the present invention;

FIG. 8 is a cross sectional fragmentary view of the cover cap and base portion of the cap of FIG. 8 in the closed position;

FIG. 9 is a cross sectional fragmentary view of the cap of FIG. 8 in the open locked position.

DETAILED DESCRIPTION OF THE PREFERRED EMBODIMENTS

Figure 1:
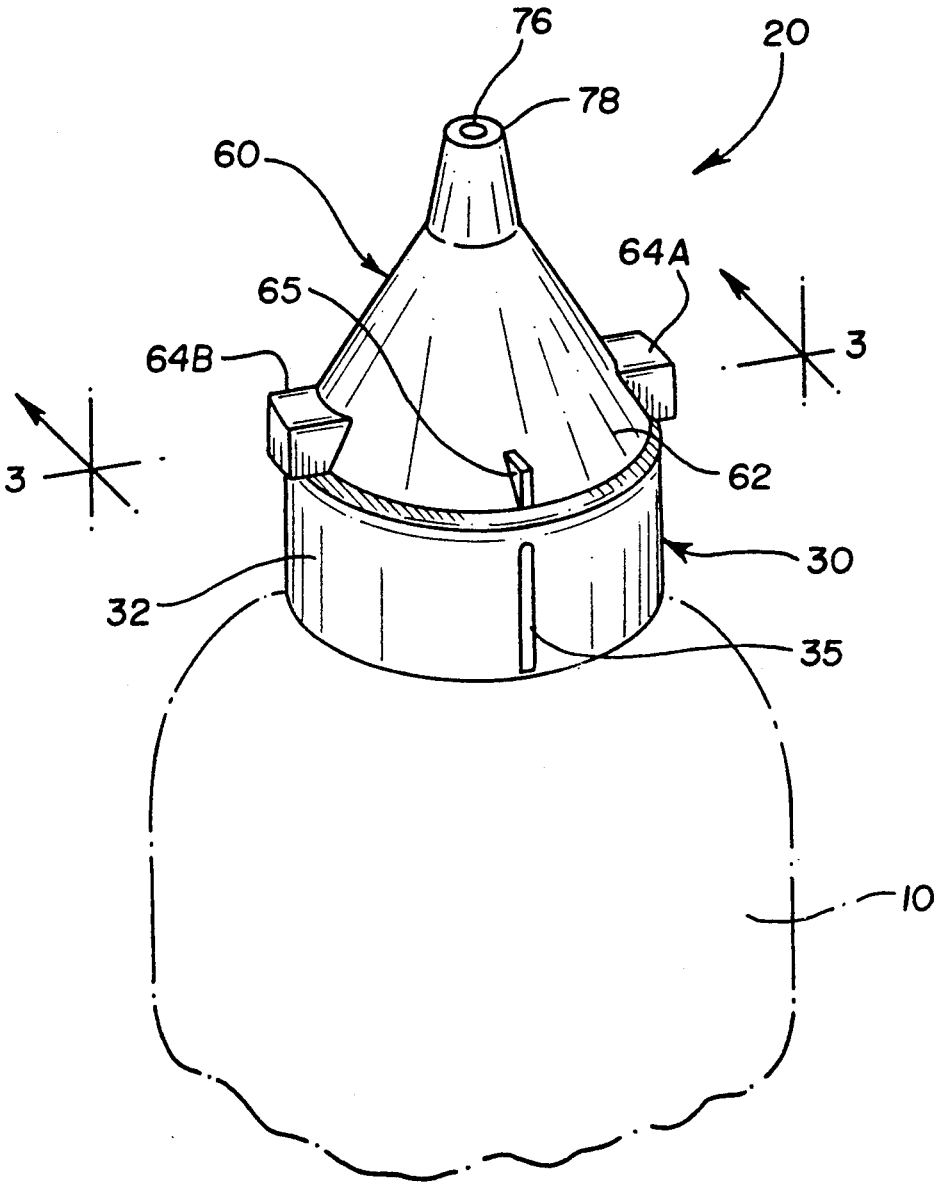
FIG. 1 is a perspective view of the child proof embodiment of the dispensing cap of the present invention.
Figure 2:
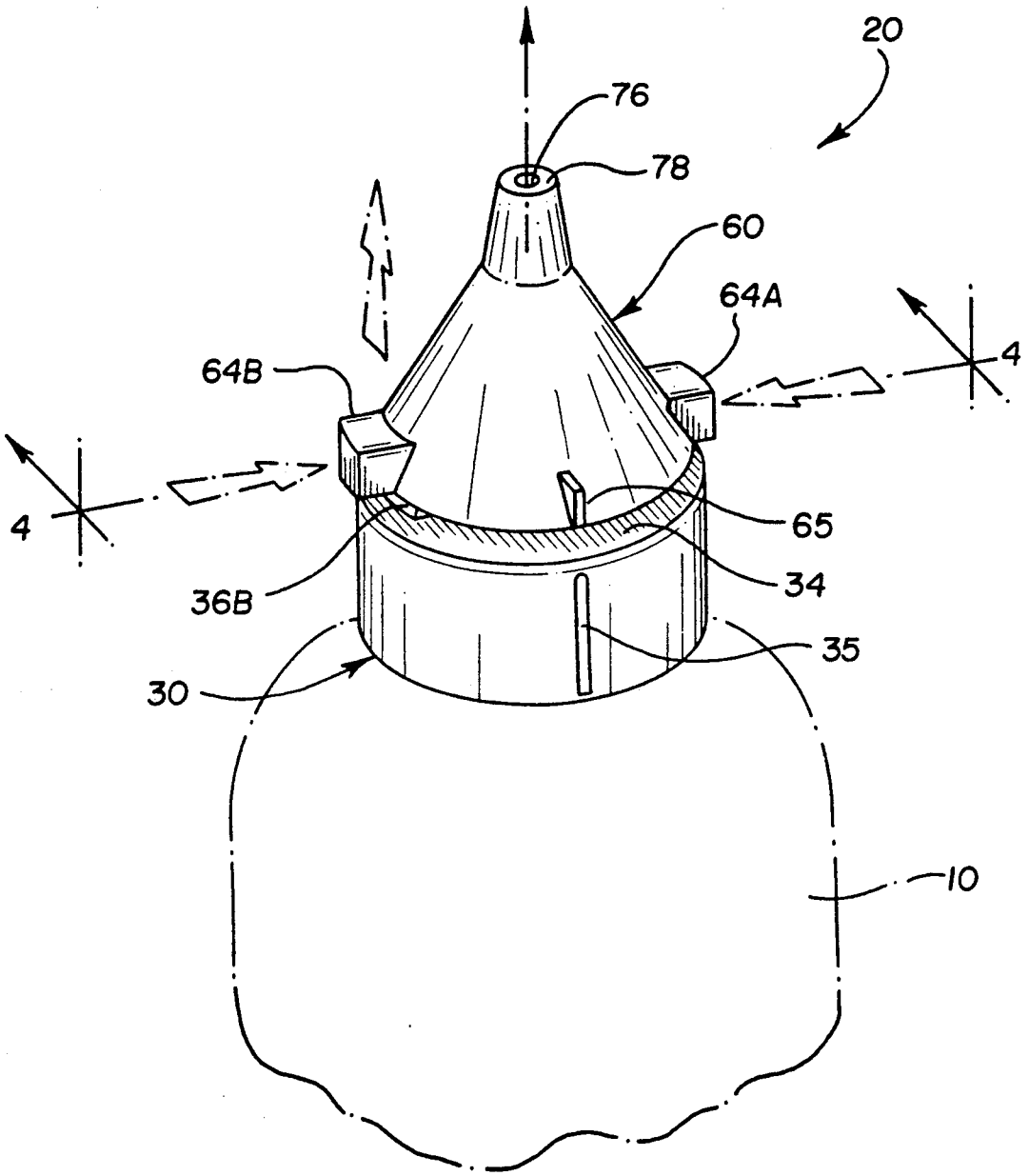
FIG. 2 is a perspective view of the dispensing cap of FIG. 1 showing the forces applied to the cap and the direction of movement of the cap during opening of the cap.

Referring to FIGS. 1–4, the dispensing cap of the present invention, indicated generally at 20, is shown. The dispensing cap 20 comprises a base portion 30 and a cover cap 60.

The base portion 30 has a relatively flat top surface 34 having a circumferentially outer portion 34A and a circumferentially inner portion 34B. Ramps 36A and B, which are arc segments, extend up from top surface 34 and divide the top surface 34 into portions 34A and B. The ramps 36A and B have a vertical face 37A and B respectively at the circumferentially inner portions of the ramps. The base 30 includes a delivery tube 40 that extends upward from the center of flat top surface 34, and terminates in enlarged top portion 46 having a tapered shoulder 44. Dispensing tube bead 42 is formed on the outer circumference of the delivery tube 40 below the tapered shoulder 44 of enlarged top portion 46. The outside diameter of the dispensing tube bead 42 and the enlarged top portion 46 are equal in size although they do not necessarily need to be. Above enlarged top portion 46 is a plug 50 which is connected to the top portion by struts 48A, B, and C. Passages are formed between the struts 48A, B, and C to allow for the flow of liquid from the delivery tube 40.

The cover cap 60 coacts with base portion 30 to open and close the passages for the escape of the liquid. The cover cap 60 has a conical skirt 62 with two protruding ears 64A and B disposed along the bottom edge of a conical skirt 62 and a spout section 66 having an exit aperture 76. Protruding ears 64A and B typically correspond to the position of the cam follower 67A and B and could be merely markings or indentions or, if the cam follower extended completely about the cover cap, could be left out entirely. Within skirt section 62 is a positioning tube 68 which extends downwardly over delivery tube 40. The positioning tube 68 has a bottom bead 70 that extends radially inward from the positioning tube 68 and is positioned between the dispensing tube bead 42 and the tapered shoulder 44 leading to the enlarged top portion 46 when the dispensing cap is in an open position, and which bottom bead 70 sits below dispensing tube bead 42 when the dispensing cap 20 is in a closed position. The bottom bead 70 coacts with the dispensing tube bead 42 to retain the cover cap 60 in a closed position until the dispensing cap 20 is opened. The bottom bead 70 coacts with the tapered shoulder 44 when the cover cap 60 is in a raised position to open the dispensing cap 20 to prevent disengagement of the cover cap 60 from the base portion 30.

The positioning tube 68 has an inner diameter matingly sized with the diameter of the enlarged top portion 46 so that a wiping seal exists between the two structures. The inner diameter of the exit passage of the cover cap 60 thereafter tapers to exit aperture 76 in stages. At point 82 the exit passage tapers parallel to the conical skirt 62 to a second point 84 where it forms an intermediate tubular passage 74. Intermediate tubular passage 74 is sized so that a wiping seal engagement exists between it and plug 50. At point 83 the exit passage again tapers to point 85 where it straightens out to form an exit aperture 76.

A marker or registration guide 35 is provided on the base portion of the child-proof embodiment (shown in FIGS. 1-5). When the marker 35 is aligned with the mark or registration guide 65 on the base portion 30 the protruding ears 64A and B corresponding to camming surfaces 67A and B of cover cap 60 are aligned in registration with the ramps 36A and B. Depression of the protruding ears 64 enables actuation of the dispensing cap 20.

Figure 3:
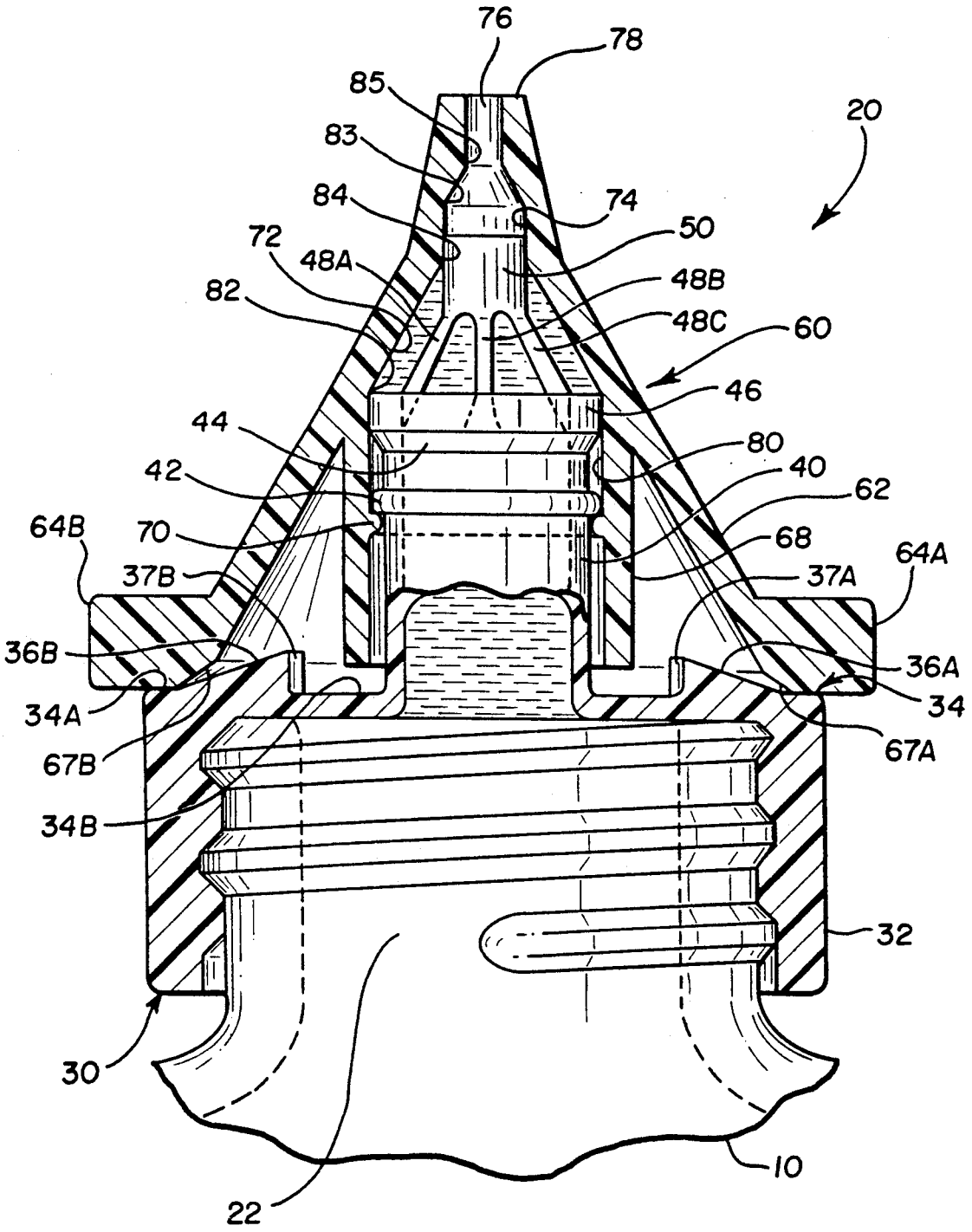
FIG. 3 is a cross sectional view of the cap of FIG. 1 showing the cap in a closed position.
Figure 4:
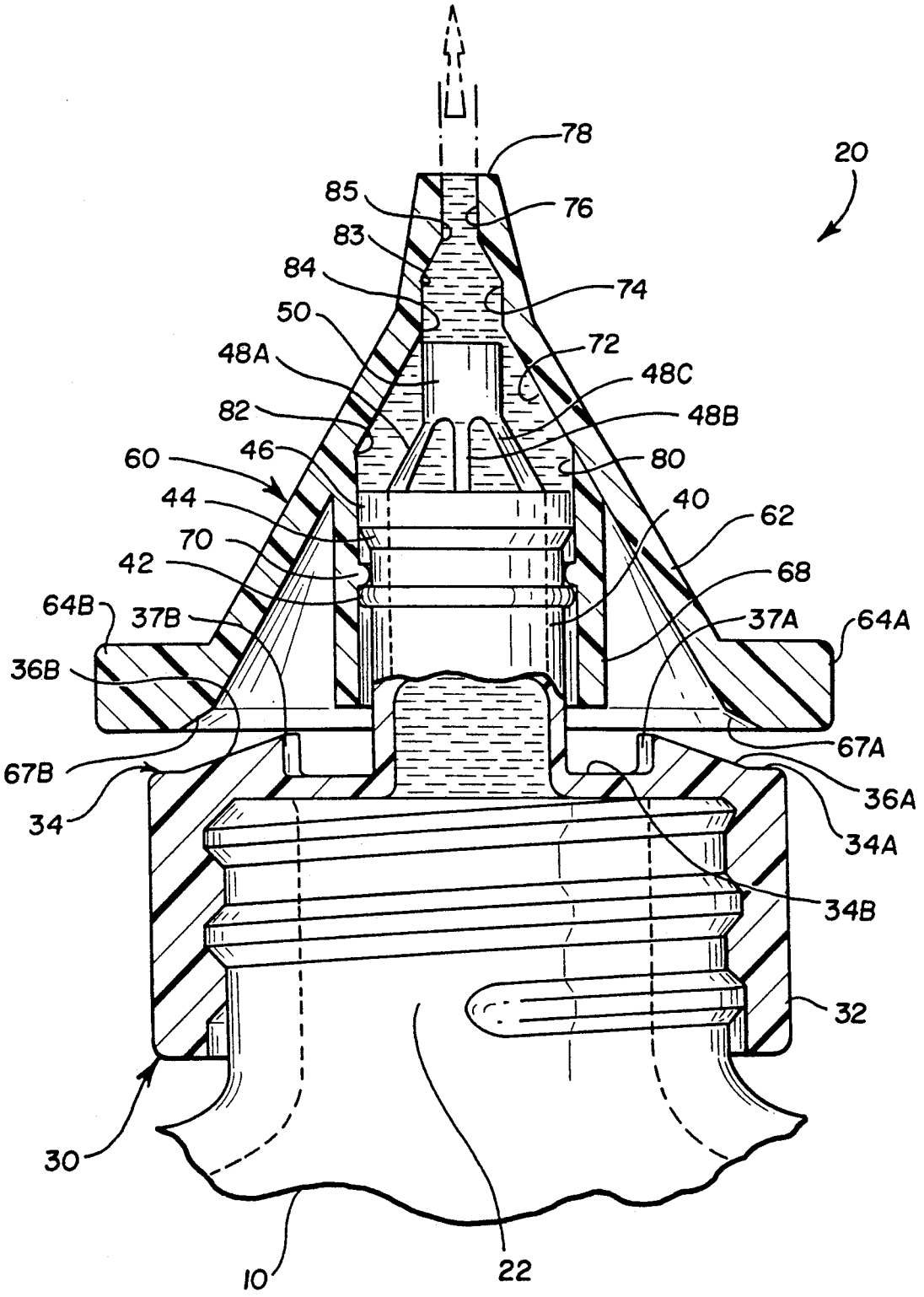
FIG. 4 is a cross sectional view of the cap of FIG. 1 showing the cap in an opened position.
Figure 5:
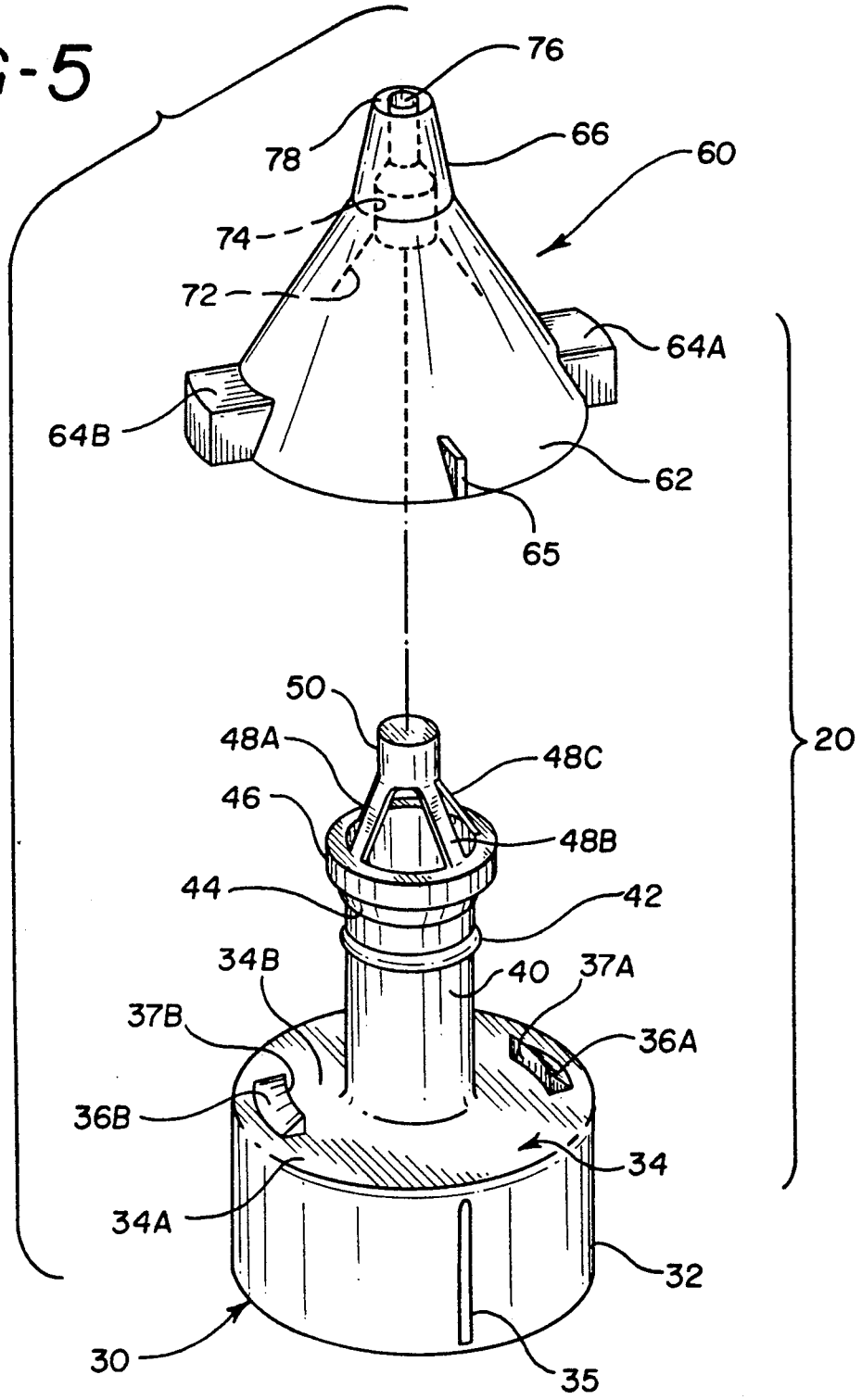
FIG. 5 is an exploded view of the cap of FIG. 1.

As shown in FIG. 3, when the dispensing cap 20 is closed, the base portion 30 is secured to the container and the cover cap 60 sits with the bottom edge of conical skirt 62 and ears 64A and B resting on the circumferentially outer portion 34A of the flat top surface 34 of the base portion 30, the bottom bead 70 of the cover cap 60 positioned below the dispensing tube bead 42 of dispensing tube 40. In this position, with the dispensing cap 20 closed, the cover cap 60 is free to revolve or rotate with respect to the base portion 30. The cover cap is held in a closed position by the coaction of the bottom bead 70 and the dispensing tube bead 42.

When the cover cap is rotated so that marker 35 registers with mark 65, the camming surfaces 67A and B of will be aligned with ramps 36A and B. Pressing the ears inward will force the camming surfaces 67A and B to coact with ramps 36A and B to raise the cover cap 60 with respect to the base portion 30. The height of the ramps 36A and B above the flat top surface 34 and the flexibility of the positioning and dispensing tubes are sufficient to raise the bottom bead 70 on positioning tube 68 above dispensing tube bead 42 to position and hold the cover cap 60 in the open, raised position.

In the closed position, with the protruding ears 64A and B resting on flat top surface 34, the plug 50 fits within intermediate tubular passage 74. The diameter in the plug 50 is sized such that a wiping engagement is created between it and intermediate tubular passage 74 to close the dispensing cap 20 and seal the container. During closure of the dispensing cap 20, deformation or squeezing of the container will result in the material within the container being forced out of the container into the delivery tube 40 of the base portion 30 and into the passages formed between the struts 48A, B and C which attach the plug 50 to the enlarged top portion 46 of the delivery tube 40 where the material will be prevented it from the traveling further because of the seal between the plug 50 and the intermediate tubular passage 74.

Once in the raised open position, the top of plug 50 is positioned below intermediate tubular passage 74 so that no seal is effected and the contents of the container can pass through dispensing tube 40 out through the passages between struts 48A, B, C and then through the space between plug 50 and the exit passage within conical skirt 72 of cover cap 60, out through the intermediate passage 74 and then through the exit aperture 76 to the end of cover cap 60. To close the dispensing cap all that need be done is to exert a downward force on the cover cap, either at the very tip 78 or anywhere on the conical skirt sufficient to force the bottom bead 70 of the cover cap over the dispensing tube bead 42, and then lower the cap to its initial position bringing plug 50 up into sealing engagement with the intermediate tubular passage 74.

It should be noted that in this child-proof embodiment, children will not be able to open the cap unless they are able to understand the relationship of the registration guides 35 and 65. These guides can be made relatively faint or even coded, if necessary, to further enhance the child-proofing of the cap.

ANOTHER EMBODIMENT

Figure 6:
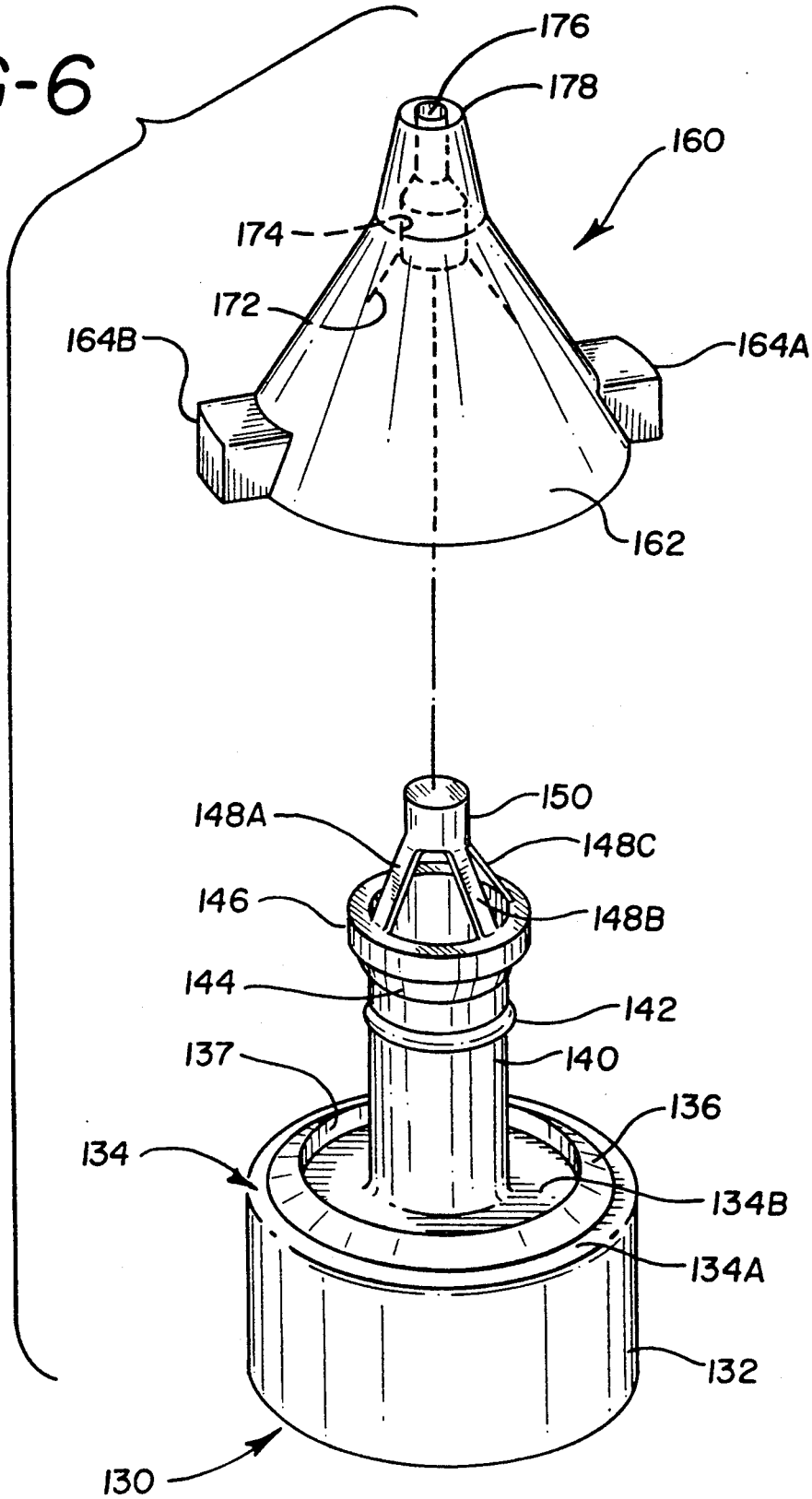
FIG. 6 is a cross sectional view of an embodiment of the dispensing cap of the present invention wherein no alignment of the cover cap with the base portion is necessary to effect opening of the cap.

The dispensing cap of the present invention can also be produced in a more easily opened configuration which does not require registration of the cover cap 160 and the base portion 130. This configuration is shown in FIG. 6 in which case the ramp sections 36A and B of the child-proof embodiment of the invention are replaced by a continuous annular camming section 136. It should be noted that objects with like reference numerals in this embodiment correspond to similar objects having like reference numerals in the first embodiment. No registration is needed to open the dispensing cap, but all other items of the cap function in the same manner as the child-proof embodiment.

ANOTHER EMBODIMENT

In another embodiment of the present invention, the dispensing cap is locked into its open position after it has been opened. Referring to FIGS. 7-9. Again, like numerals correspond to objects having like numerals in previous embodiments. The non-closing ability is accomplished by placing a series of teeth 265B2 and 265B3 on the underside of camming surface 267B. Teeth 265B2 and 265B3 coincide with and are adapted to mate with a series of ridges 237B2 and B3 in the annular ramp 237. Once the protruding ears 264A and B of the cover cap 260 are squeezed, the camming action between the camming surfaces 267A and B of and the annular ramp 237 cause the teeth 265B2 and B3 respectively to engage the ridges 237B2 and B3 to retain the cap in its raised, open position. Additionally, this embodiment of the invention could be adapted to be child-proof by the incorporation of a registration system between cover cap 260 and by replacement of annular ramp 237 with ramp segments as in the child-proof embodiment of FIGS. 1-5. Typically, beads on the delivery tube and positioning tube respectively are formed asXin the previous embodiments, though, the beads could be omitted from this embodiment if sufficient friction existed between the delivery tube and the positioning tube to keep the cap closed, and when the cap is opened it remains open as a result of the coaction between the teeth and the ridges.

It must be pointed out that the narrow section is formed in the wall of the conical skirt above the protruding ear 264A. This narrow section 267 allows the ears to be permanently deformed to retain the cover cap in the raised position without unduly stressing and distorting the remainder of the conical skirt of the cap. Similarly for protruding ear 264B (not shown).

ANOTHER EMBODIMENT

Figure 10:
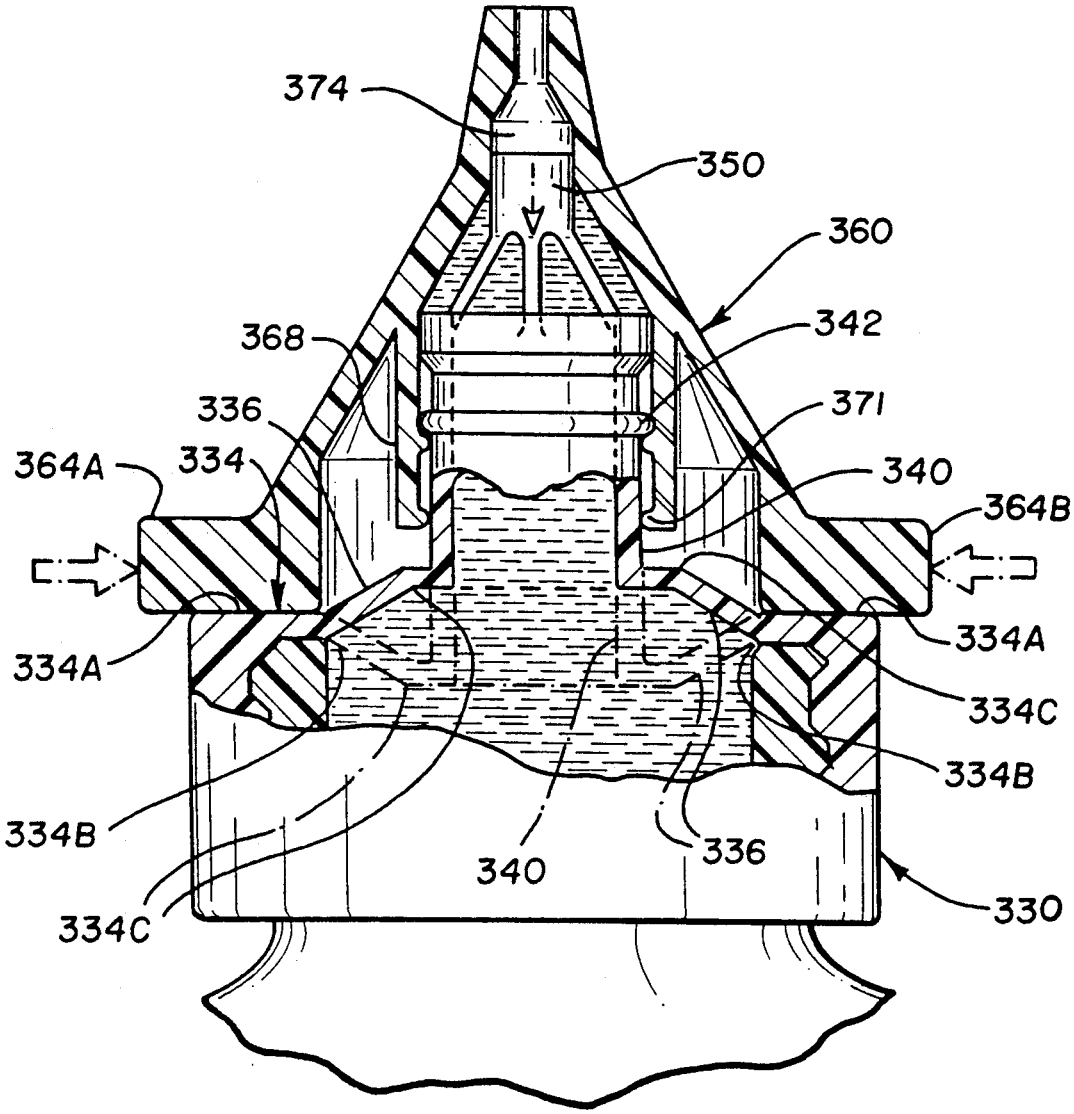
FIG. 10 is a cross sectional view of an alternative embodiment of the present invention wherein the dispensing tube is moved downward with respect to the cover cap to open the cap (shown by dotted lines).

In an alternative embodiment of the invention, shown in FIG. 10, where like numerals correspond to objects having like numerals in the previous embodiments, the flat top surface 334 of the base portion 330 has a linking section 334A defined by pinched thin walls 334B and C which extend circumferentially about flat top surface 334. In the closed position, the linking section 336 extends upward at an angle from the outer portion 334A of top surface 334. The outer portion 334A of the top of the base remains the same as in previous embodiments. The protruding ears 364A and B remain in contact with the flat top surface 334A and all other parts remain in contact as was previously described in connection withXFIGS. 1 through 5 when the cap is in the closed position. A second internal bead 371 is formed at the bottom edge of the positioning tube 368. This internal bead 371 coacts with dispensing tube bead 342 on the delivery tube 340 to prevent the exit tube from being displaced, when in the closed position, beyond its intended limits.

In this embodiment, rather than the cover cap rising upon compression of the protruding ears 364A and B to coact the camming surface with the ramps and raise the cap as was the case in the previous embodiments, instead, the cover cap 360 is maintained in the same relative position with respect to the base portion 330 and the linking section 336 is acted upon by the protruding ears 364A and B, upon compression thereof, to produce a camming effect such that the linking section is caused to snap downward within the base portion, bringing the entire delivery tube of the base portion down within the base portion, therefore lowering the plug 350 from within the intermediate tubular section 374 to open the sealing engagement between the plug 350 and the tube 374, and allow the contents of the container to flow from the container.

Preferably, the dispensing cap of this embodiment, upon opening, remains open, though it could be formed such that upon the application of greater pressure than a threshold level to the contents of the container, the linking section would be forced up out of the base portion to a closed position where the plug is in engagement with the intermediate tubular passage to close the cap.

Alternatively, this embodiment could be structured such that upon compression of the cover cap, the cam follower coacts with the linking section to raise the cap such that the positioning tube head is pushed over the delivery tube bead to retain the cap in a raised, open position. In this alternative, the retaining force of the beads would be great enough such that if the cap were to be pushed down to attempt to close the cap, the linking section would pop down to lower the delivery tube into the container. This alternative therefore provides a non-recloseable cap because after the linking section pops down, the cover cap will contact the seating portion of the base and prevent the further depression of cap with respect to the delivery tube.

The dispensing cap of the present invention, in all embodiments can be operated, i.e. opened and closed, with one hand. The shoulder of the container can be grasped in the heel of the palm of the hand with the ring and pinkie fingers, the top rotated (in the child-proof embodiment) by pushing the ears with the thumb until the registration guides are aligned, the ears grasped between the thumb and forefinger and squeezed to open the cap. Closing the cap, in embodiments that allow for the closure thereof, is relatively simple to do by merely depressing the cover cap.

It should be noted that the protruding ears may be attached to the conical skirt of the cover cap by a pinched section, i.e. a memory joint.

Having thus described my invention in detail, it is to be understood that the foregoing description is not intended to limit the spirit and scope thereof. What is desired to be protected by Letters Patent is set forth in the appended claims.

What is claimed is:

1. An apparatus for dispensing contents from a container comprising:

base means;

attachment means on said base means adapted to attach said base means to a container;

delivery tube means extending from said base means;

cam means disposed on said base means;

plug means connected to said delivery tube means on said base means;

cover cap means;

positioning tube means extending from said cover cap means adapted to concentrically fit with said delivery tube means on said base means;

exit means in said cover cap means sized to coact with said plug means to seal said cover cap means when said plug means is positioned within said exit means; and cam follower means on said cover cap means, said cam follower means movable radially for coacting with said cam means to move said cover cap means vertically with respect to said base means to remove said plug means from said exit means to open said cover cap means upon relative horizontal movement between said cam means and said cam follower means.

2. The apparatus of claim 1 wherein said delivery tube means includes first bead means which coacts with a second bead means provided on said positioning tube means to retain said cover cap means in a closed position prior to actuation of said cam means.

3. The apparatus of claim 1 wherein said plug means is mounted to the top of said delivery tube means by strut means which allow the contents of the container to flow therebetween.

4. The apparatus of claim 1 wherein said cam follower means is disposed within said cap means.

5. The apparatus of claim 4 further comprising protruding ears extending from said cap means, said protruding ears positioned adjacent to said cam follower means.

6. The apparatus of claim 5 wherein said protruding ears are formed on opposite sides of said cap means.

7. The apparatus of claim 6 wherein the cap means is deformable to allow for movement of said cam follower means when said protruding ears are compressed.

8. The apparatus of claim 7 wherein said cam means comprise a pair of sectors disposed on said base means in diametric relationship.

9. The apparatus of claim 8 further comprising indicia for indicating alignment of said cam follower means with said cam means.

10. A dispensing cap comprising:

a base comprising:

a cylindrical skirt having fastening means, the skirt sized to accept the neck of a container and fasten the base thereto;

a top surface having a circumferentially outer seating surface and a camming surface;

a delivery tube extending upward from the base, the tube having a conical portion extending to an enlarged top section;

a bead formed on the outer circumference of the delivery tube between the top surface of the base and the enlarged top section of the delivery tube;

a plug mounted above the delivery tube, the plug connected to the delivery tube by a plurality of struts;

a cover cap comprising:

a conical section;

a positioning tube extending from within the conical section, the positioning tube circumferentially disposed about the delivery tube from the base;

a bottom bead extending radially inward from the positioning tube to coact with the delivery tube bead to retain the relative position of the cap with respect to the base;

a dispensing passage narrowing in stages to an outlet orifice in the cover cap;

an intermediate stage of the dispensing passage adapted to coact with the plug to seal the cap when the plug is positioned within the intermediate stage;

cam follower means disposed on the cap in opposed relation to the camming surface;

protruding ears on the cover cap corresponding to the location of the cam follower means;

wherein compression of the protruding ears towards each other will cause the cam follower means to contact with the camming surface on the base to coact the cam follower means with the camming surface to raise the cover cap with respect to the base and to cause the bottom bead on the positioning tube to move over and beyond the bead on the delivery tube to retain the cap in a raised position where the plug is out of the intermediate stage and a flow path is created through the delivery tube and the positioning tube to the outlet orifice.

11. The apparatus of claim 10 wherein the cap means is deformable to allow for movement of said cam follower means when said protruding ears are compressed.

12. The apparatus of claim 10 wherein said camming surface means comprises a pair of sectors disposed on said base means in diametric relationship.

13. The apparatus of claim 12 further comprising indicia means for indicating alignment of said cam follower means with said camming surface.

14. A method of opening and closing a cap comprising the steps of:

providing a cap with a base with a delivery tube and a deformable cover cap with an exit passage, the base and the cover cap being axially and rotationally moveable with respect to one another;

aligning the cover cap with the base by rotating the cover cap with respect to the base so that markers provided on the cover cap and the base are aligned;

providing a camming surface means on the base;

providing a cam follower means on the cover cap;

compressing opposing sides of the cover cap together to deform the cover cap and move opposite sides of the cover cap toward each other;

camming the cam follower means against the camming surface means on the base to move the cover cap axially upward with respect to the base;

forcing the cover cap over a restraining means to retain the cover cap in a raised position with respect to the delivery tube; and unsealing an exit passage by removing a plug mounted on the delivery tube from the exit passage of the cover cap by moving the cover cap axially upward with respect to the delivery tube.

15. A method of opening and closing a cap comprising the steps of:

providing a cap with a base and a deformable cover cap, the base and the cover cap being axially moveable with respect to one another;

providing a camming surface means on the base and a cam follower means on the cover cap;

compressing opposing sides of the cover cap together to deform the cap and move the sides toward each other;

camming the cam follower means against the camming surface means on the base to move the cover cap axially upward with respect to the base; and unsealing an exit passage by moving the cap to a raised position.

16. The method of claim 15 further comprising, after the step of camming the cam follower means against the camming surface means, the step of forcing the cover cap over a restraining means to retain the cover cap in a raised position.

17. The method of claim 16 further comprising the step of aligning guide means on the cover cap with guide means on the base before camming the cam follower means against the camming surface means.

18. An apparatus comprising:

a base adapted to be threadably engaged to the neck of a container;

a cover cap slidably attachable to said base;

outlet conduit means on said base;

outlet conduit means on said cover cap adapted to be matingly and concentrically disposed about said outlet conduit on said base;

support means on said outlet conduit on said cover cap, and support and positioning means on said outlet conduit on said base;

camming means on said base;

cam follower means on said cap;

wherein said cam follower means is movable radially to coact with said camming means to raise said cap so that said positioning and support means on said outlet conduits on said cap and said base coact to retain said cap in a raised position.

19. The apparatus of claim 18 further comprising plug means mounted to the top of said outlet conduit on said base by strut means.

20. The apparatus of claim 19 further comprising a dispensing passage in said cover cap, said dispensing passage sized to accept said plug means in a sealing relationship when said cover cap is in a lowered position, said plug means removed from said dispensing passage when the cover cap is in the raised position.

21. The apparatus of claim 19 wherein said cam means comprise a pair of sectors disposed on said base in diametric relationship.

22. The apparatus of claim 21 further comprising indicia for indicating alignment of said cam follower means with said cam means.

* * * * *